US008584796B2

(12) United States Patent
Lara

(10) Patent No.: US 8,584,796 B2
(45) **Date of Patent: *Nov. 19, 2013**

(54) METHOD FOR FITTING A SAFETY LINE CABLE ON A TENSIONER

(75) Inventor: Pascal Lara, Nice (FR)

(73) Assignee: Capital Safety Group EMEA, Carros Cedex (FR)

( * ) Notice: Subject to any disclaimer, the term of this patent is extended or adjusted under 35 U.S.C. 154(b) by 1288 days.

This patent is subject to a terminal disclaimer.

(21) Appl. No.: 11/913,180

(22) PCT Filed: May 23, 2006

(86) PCT No.: PCT/EP2006/062544

§ 371 (c)(1),
(2), (4) Date: Oct. 31, 2007

(87) PCT Pub. No.: WO2006/125783

PCT Pub. Date: Nov. 30, 2006

(65) Prior Publication Data

US 2008/0156587 A1 Jul. 3, 2008

(30) Foreign Application Priority Data

May 24, 2005 (FR) ..... 05 51357

(51) Int. Cl.
*A47L 3/04* (2006.01)

(52) U.S. Cl.
USPC ..... 182/3; 24/69 WT; 24/115 A; 24/115 F; 24/115 G; 52/223.13; 185/45; 188/372

(58) Field of Classification Search
USPC ..... 182/3, 45; 254/262, 134.3 FT, 134 R, 254/245, 246, 387; 24/69 WT, 71 CT, 129 A, 24/115 A, 115 F, 115 G, 122.6; 104/117; 211/119.16; 52/223.13
See application file for complete search history.

(56) References Cited

U.S. PATENT DOCUMENTS 3,087,584 A * 4/1963 Jackson et al. ..... 188/372
3,965,543 A * 6/1976 Connors ..... 24/136 R (Continued)

FOREIGN PATENT DOCUMENTS

EP 272908 A2 6/1988
EP 0 273 673 A1 7/1988

(Continued)

OTHER PUBLICATIONS

Flap n. 1. A flat, usually thin piece attatched at only one side. The American Heritage® Dictionary of the English Language, Fourth Edition copyright © 2000 by Houghton Mifflin Company. Updated in 2009. Published by Houghton Mifflin Company. All rights reserved.*

(Continued)

*Primary Examiner* — Katherine Mitchell
*Assistant Examiner* — Daniel Cahn
(74) *Attorney, Agent, or Firm* — IPLM Group, P.A.

(57) ABSTRACT

A tensioner as well as a method for fitting a safety line cable on the tensioner. The tensioner designed for the safety of personnel attached to the cable while working under dangerous conditions. The tensioner has a fixing element configured to couple to an external element such as a wall and has two sections capable of separating and absorbing energy as a result of a fall of a worker while attached to the safety line cable. A section of the cable passes through and is crimped in a sleeve of the tensioner while the cable is kept under tension.

16 Claims, 4 Drawing Sheets

(56) References Cited

U.S. PATENT DOCUMENTS

| | | | | | |
|---|---|---|---|---|---|
| 4,558,584 | A | * | 12/1985 | Myers | 72/407 |
| 4,790,410 | A | * | 12/1988 | Sharp et al. | 182/36 |
| 5,015,023 | A | * | 5/1991 | Hall | 294/102.1 |
| 5,015,205 | A | | 5/1991 | Franks, Jr. | |
| 5,297,651 | A | | 3/1994 | Vandelinde et al. | |
| 5,400,868 | A | | 3/1995 | Ellis et al. | |
| 5,458,214 | A | | 10/1995 | Olson et al. | |
| 6,001,098 | A | | 12/1999 | Metz-Stavenhagen et al. | |
| 6,076,236 | A | | 6/2000 | DeFrance | |
| 6,338,399 | B1 | | 1/2002 | Choate | |
| 6,425,458 | B1 | | 7/2002 | Soll | |
| 6,761,722 | B2 | * | 7/2004 | Cole et al. | 606/74 |
| 7,163,083 | B2 | | 1/2007 | Argoud | |
| 2002/0134618 | A1 | | 9/2002 | Timmermans | |
| 2004/0193217 | A1 | * | 9/2004 | Lubbers et al. | 606/232 |
| 2005/0033366 | A1 | * | 2/2005 | Cole et al. | 606/232 |
| 2005/0034920 | A1 | | 2/2005 | Anderson | |
| 2005/0146071 | A1 | * | 7/2005 | Tiemeier et al. | 264/103 |
| 2005/0177022 | A1 | * | 8/2005 | Chu et al. | 600/30 |
| 2006/0113147 | A1 | | 6/2006 | Harris, Jr. | |
| 2008/0006750 | A1 | | 1/2008 | Flux | |
| 2008/0184534 | A1 | | 8/2008 | Lara | |

FOREIGN PATENT DOCUMENTS

| | | | |
|---|---|---|---|
| GB | 2 336617 | A | 10/1999 |
| GB | 2354052 | A | 3/2001 |
| GB | 2 403 256 | A | 12/2004 |
| WO | WO 93/06384 | | 4/1993 |
| WO | WO 99/22816 | A | 5/1999 |
| WO | 00/47285 | A | 8/2000 |
| WO | WO 00/47285 | A | 8/2000 |
| WO | WO 01/87420 | A1 | 11/2001 |
| WO | WO 03/039680 | A1 | 5/2003 |
| WO | PCT/EP2006/062544 | | 5/2006 |
| WO | PCT/EP2006/062548 | | 5/2006 |
| WO | WO 2006/103259 | A1 | 10/2006 |
| WO | WO 2006/125783 | A1 | 11/2006 |

OTHER PUBLICATIONS

International Search report of PCT/EP2006/062544 mailed Jul. 28, 2006.

International Search Report of PCT/EP2006/062548 mailed Jul. 25, 2006.

Non-Final Office Action for U.S. Appl. No. 11/913,183 mailed Jun. 30, 2010.

U.S. Appl. No. 11/913,180, filed Oct. 31, 2007.

U.S. Appl. No. 11/913,183, filed Oct. 31, 2007.

* cited by examiner

METHOD FOR FITTING A SAFETY LINE CABLE ON A TENSIONER

This invention relates to a method for fitting a safety-line cable to a tensioner, together with a tensioner capable of being used for the execution of this method.

The invention applies in particular to the safety installations generally referred to as life-lines or safety lines that enable personnel to put on a harness for operations carried out under dangerous conditions. The invention relates to the installation of safety lines consisting generally of cables on which persons are able to secure themselves in order to avoid injuries resulting from accidental falls.

The safety lines must be connected to each other or to fixed elements, particularly support posts or even wall fixings. In this connection use is currently made of tensioners that allow on the one hand fixing on an external element (such as the wall partition) and on the other hand the connection of the safety line cable. The tensioners of prior art also sometimes include a damping element capable of at least partially absorbing a proportion of the energy generated by possible tension on the safety line cable.

The safety line cable is generally connected to the tensioner by crimping said cable inside a sleeve. The cable is initially cut to length so that it can be received in the sleeve, and is preferably kept under tension at a predetermined value, whereupon the crimping is carried out.

It will be readily understood that adjustment of the length of the cable and keeping it under tension according to this configuration present a number of practical drawbacks as far as the operating personnel are concerned. Indeed, these operations involve difficult steps and generally require two or three persons. Moreover, because it is difficult to adjust accurately the length of the cable to be cut, the tension is difficult to adjust.

This invention enables all or some of the disadvantages of the tensioners and methods of fitting of prior art to be remedied.

According to the invention the fitting of the cable is rendered much more practical to the extent that the cable is passed entirely through the sleeve so that it projects from it, it being possible for the end of the cable to be easily retained during the crimping operation and for the length of the cable to be perfectly adjusted before it is cut.

This invention relates to a method of fitting a safety line cable on a tensioner in which a portion of the cable is crimped in a sleeve formed on the tensioner. According to the invention the following operations are carried out:

- passing the cable through the sleeve,
- keeping the cable under tension by its end projecting from the sleeve,
- crimping of the cable in the sleeve.

According to advantageous variants, this fitting method is such that:

- the end of the cable projecting from the sleeve is selected,
- whilst the cable is kept under tension, the tension is adjusted to a predetermined value before carrying out the crimping.

This invention also relates to a tensioner for a safety line that comprises means of fixing to an external element at one end and a sleeve for crimping a portion of the safety line cable at the other end. According to the invention this tensioner is such that:

- the sleeve is provided with an opening hole for passing the cable through the sleeve,
- it is provided with an opening configured to allow access from the outside of the tensioner to the end of the cable projecting from the sleeve in order to ensure that it is kept under tension during crimping of the cable in the sleeve.

This tensioner is preferably such that:

- the opening can be sealed by a flap,
- it comprises a duct capable of guiding the end of the cable between the hole in the sleeve and the opening,
- a hollow rod is mounted at the end of the sleeve, the cable also crossing the hollow rod,
- the rod is mounted so that it performs a translatory movement opposing elastic means of return relative to the rest of the tensioner,
- the elastic means of return comprise a spring surrounding the rod,
- it comprises a duct capable of guiding the end of the cable between the output of the hollow rod and the opening.

The appended drawings are given as an example and do not limit the invention. They represent only one embodiment of the invention and allow it to be easily understood.

The tensioner shown here generally comprises a first end provided with a sleeve 11 allowing the fixing, by crimping, of a safety line cable.

At the other end of the tensioner, fixing means 15 are provided to connect the tensioner to an external element such as a system for fixing on a wall or to a post, or even to another safety line cable.

Figure 1:
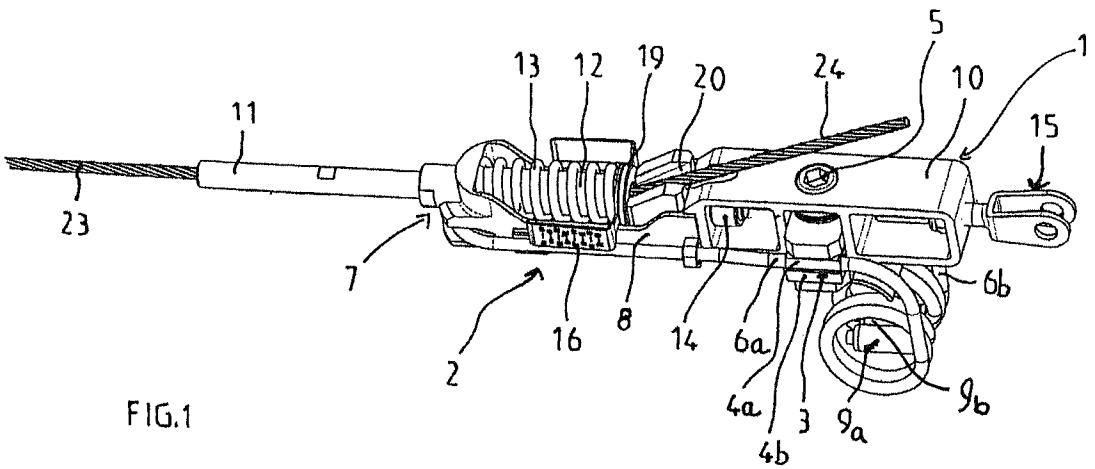
FIG. 1 shows different internal components of the tensioner, together with the passage of a life-line cable through it.
Figure 2:
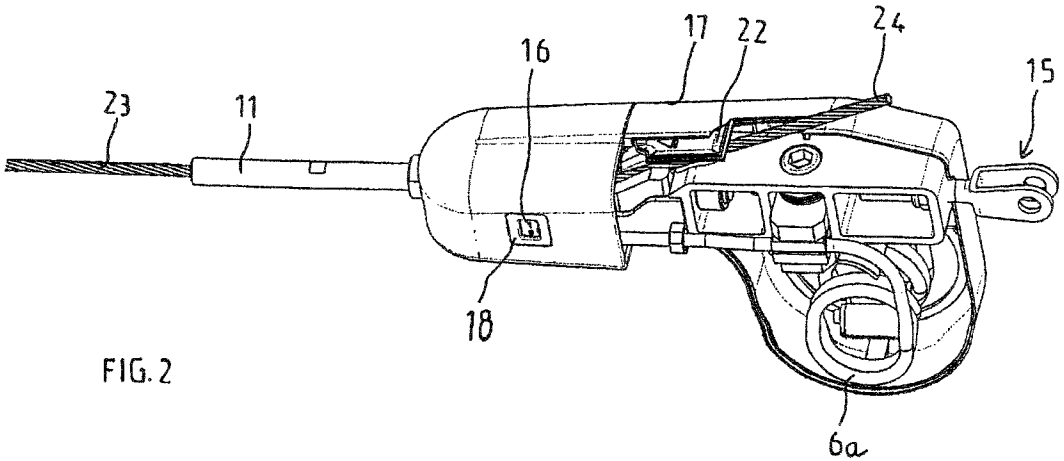
FIG. 2 shows a view of the tensioner with the case partially removed.

Between these two ends the tensioner comprises a mechanism covered by a case 17, an example of which is shown in FIG. 1.

In a first step, end 24 of safety line cable 23 is inserted through sleeve 11 of rod 12, which follows it so that it reaches a guide duct 20. This duct 20 is advantageously inclined to produce a deviation from end 24 as far as an opening 21 arranged in the upper section of case 17. In the fitting phase, this opening 21 is released by the displacement of a sealing flap 22. A cable position is obtained such as that shown in FIG. 3.

By applying tension to end 24, the length of cable 23 may be adjusted as well as its tension. Measurement means of prior art are advantageously used at this stage to adjust the force level.

Cable 23 is then crimped by plastic deformation of sleeve 11 according to crimping methods of prior art. The positive connection of cable 23 and sleeve 11 is then effective. The tension of the cable is therefore the final tension.

End 24 of the cable projecting from the tensioner may then be cut and sealing flap 22 re-closed, by a sliding mechanism, for example.

Figure 4:
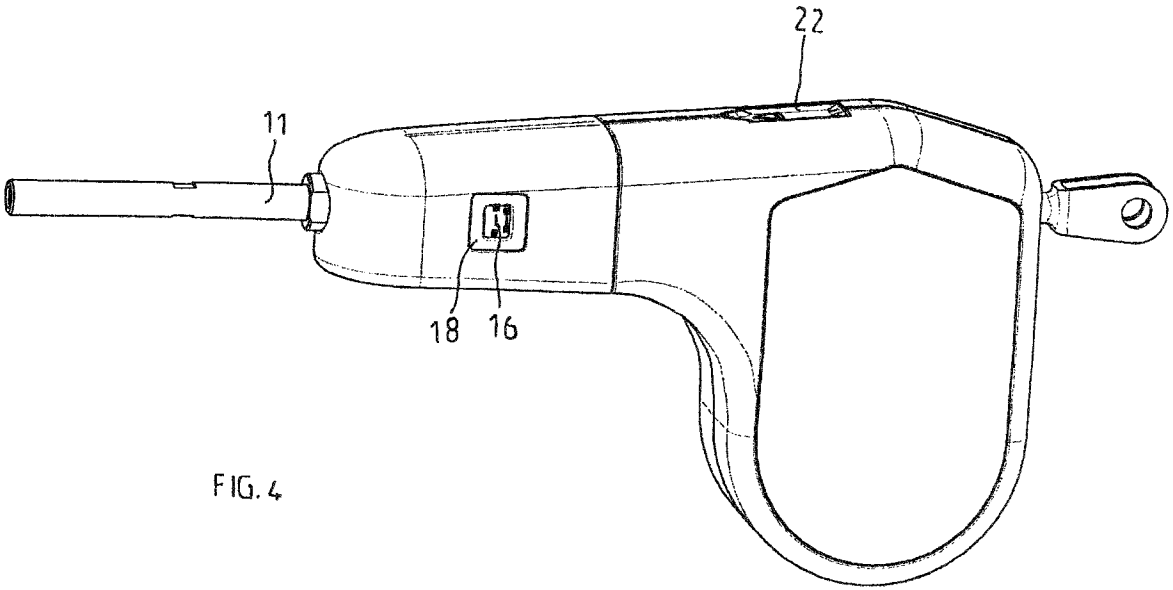
FIG. 4 illustrates the tensioner in the position of use after fitting of the cable.

The normal position of use, shown in FIG. 4, is then obtained.

It will be readily understood that during these operations one or more operating personnel are sufficient for precise, effective installation.

It will be noted that it is possible to adjust the cable tension by the relative displacement of certain parts of the tensioner, in particular by displacing sleeve 11 relative to rod 12 by means of threading, or even by modifying the length of fixing means 15. A graduated panel 16 visible through a window 18 enables the value of the tension to be adjusted.

In the inner volume of case 17 a tension system and an energy absorption device are formed in the case shown. These elements are described in the following by way of example.

Referring to FIG. 1, the energy absorption device comprises two sections 1, 2 that move relative to each other and whose relative positions during the absorption of shocks are shown in FIG. 4.

One of the sections, referred to in the following as fixed section 1, comprises a frame 10, a metal frame for example, on which are mounted fixing means 15, for example by means of a threaded rod and nut system. Frame 10 also enables pairs of jaws 4*a*, 4*b* to be received, the jaws being formed here in a single stay assembly 3, comprising an upper and lower plate in which are made two passages for cable portions 6*a*, 6*b*, which are essentially parallel with each other and with the direction of tension on the safety line.

Means for adjusting the tightening of stay 3 are provided here in the form of a tightening screw 5, whose tightening torque may be adjusted in order to vary the relative friction between cable portions 6*a*, 6*b* and stay 3.

Cable portions 6*a*, 6*b* comprise a free section terminated by limit stops 9*a*, 9*b*, and another end capable of being driven in a translatory movement during absorption of a shock.

As shown, the two cable portions 6*a*, 6*b* are advantageously constructed on the same cable comprising a turning zone7, essentially at its center and in conjunction with the axis of sleeve 11 in order to produce two symmetrical portions 6*a*, 6*b* at various points along the longitudinal axis of the assembly.

Figure 3:
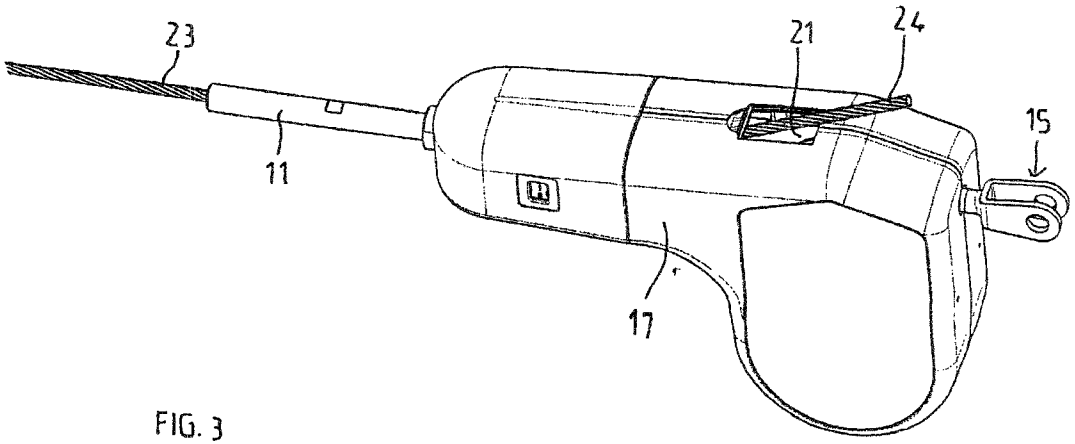
FIG. 3 shows an external view of the tensioner with passage of the cable through an opening.

For the purpose of guiding the cable forming portions 6*a*, 6*b*, a turning part 8 is formed with a longitudinal section and a rounded, essentially transversal section capable of receiving the cable at the level of turn 7, as shown in FIGS. 3 and 4.

By sliding relative to turning part 8, a rod 12, integral with sleeve 11, moves in opposition to elastic means of return, here in the form of a spring 13 surrounding rod 12 on a section of its length between turning part 8 and a cupped dish 19 at the end of rod 12. It is therefore understood that in the normal position (i.e. without energy absorption due to falls), the assembly consisting of the safety line cable, sleeve 11 and rod 12, may perform a slight translatory movement relative to the rest of the device, thereby constituting a light, reversible damping system.

The tension of the safety line cable may also be controlled by adjusting the length of the entire tensioner, in particular by adjusting fixing means 15, or even by providing a threaded connection between sleeve 11 and rod 12, enabling the assembly to be shortened or extended.

In the normal position sections 1 and 2 are positively connected, and their relative movement is only produced in the case of an accidental fall. To prevent any untimely release of the absorption device at low force levels, a fuse system is provided to ensure that the release does not occur until a predetermined threshold is exceeded.

In the case shown, the fuse means comprise a fuse nut 14, fitted to an internal section of body 10 and interacting, by threading, with one threaded rod end integral with turning part 8. For example, the rod section is formed in a relatively hard material such as steel, and fuse nut 14 is formed in a less hard material such as aluminium. Thus by adjusting the strength of the threaded connection between nut 14 and the threaded rod of turning part 8, sections 1 and 2 are not set in motion until a predetermined force threshold is exceeded. This threshold is easily adjustable, in particular by modifying the properties (e.g. height) and the material of nut 14.

An example of the use of a tensioner of the invention is given below.

In the first place the tensioner is mounted on an external element such as a fixed wall, by fixing means 15. At its other end it is connected to the end of a safety line cable by crimping the cable in sleeve 11. During this stage, and afterwards by adjusting the length of the tensioner (in particular, by relative displacement of fixing means 15 and body 10, or sleeve 11 and rod 12), it is possible to adjust the tension applied to the life-line.

In the normal position of use, no movement between sections 1 and 2 is produced and a translation of rod 12 opposing spring 13 enables slight variations in tractive force applied by the safety line cable to the tensioner to be damped.

In the event of an accidental fall the person connected to the safety line exerts an additional tension on the safety line cable, and consequently on the tensioner. At this level of force the fuse connection is broken, in particular by tearing of the threads of fuse nut 14 in a material softer than the threaded rod. It will be readily understood that a relative movement between section 1 and section 2 is then possible by ensuring that turning part 8 is entrained with sleeve 11 and rod 12 from right to left.

Case 17, in two portions, follows this movement.

During this phase, portions 6*a*, 6*b* are displaced by rubbing on the walls of the passages formed in stay 3. This friction produces an energy absorption. If the displacement continues, limit stops 9*a*, 9*b* applied to the side of stay 3 are reached.

When the energy of the fall has been observed, at least partially, the assembly is fixed in the position of relative distance between sections 1 and 2.

The formation of two cable portions 6*a*, 6*b* enables the assembly to be balanced in the direction of tension and gives rise to two symmetrical zones of friction. Another advantage of this embodiment is to allow the use of cables of smaller diameter than if a single cable were to be formed, thereby guaranteeing greater winding capacity of the free end of cable portions 6*a*, 6*b*, and a greater length. These windings are received in a volume dedicated for this purpose formed in a cavity inside case 17.

References

1. Fixed section
2. Mobile section
3. Stay
4*a*, 4*b*. Jaw
5. Tightening screw
6*a*, 6*b*. Cable portion
7. Turn
8. Turning part
9. Limit stop
10. Frame
11. Crimping sleeve
12. Rod
13. Spring
14. Fuse nut
15. Fixing means
16. Graduations
17. Case
18. Window
19. Dished plate
20. Canal
21. Opening
22. Sealing flap
23. Safety line
24. End

The invention claimed is:

1. A tensioner for a safety line cable comprising:

a fixing element coupled to a first end of the tensioner for fixing the tensioner to an external element;

a sleeve coupled proximate a second end of the tensioner for crimping a section of the safety line cable proximate the second end of the tensioner, the sleeve having a hole for passing the safety line cable through the sleeve;

a case having an opening, the opening in the case configured and arranged to allow an end of the safety line cable to pass through the sleeve and out of the opening of the case to allow access to the end of the safety line cable so a tension can be applied to the end of the safety line cable when the safety line cable is crimped in the sleeve; and a first section, the sleeve directly coupled to the first section;

a second section, the fixing element directly coupled to the second section; and a fastener configured and arranged to selectively release the first section from the second section as a direct result of a predetermined pulling apart force threshold encountered between the first section and the second section;

wherein the fastener further comprises:

a threaded rod coupled to the first section; and a fuse nut threadably engaging the threaded rod, the fuse nut formed of material that is less hard than a material of the threaded rod to allow the release of the two sections after said force threshold is reached.

2. The tensioner according to claim 1, further comprising;

a duct configured and arranged to guide the end of the safety line cable between the hole in the sleeve and the opening in the case.

3. The tensioner according to claim 1, wherein further comprising;

a hollow rod mounted to an end of the sleeve to allow the safety line cable to pass through the hollow rod.

4. The tensioner according to claim 3, wherein the hollow rod is mounted so that it performs a translation movement as a result of an elastic return force when the safety line cable is crimped in the sleeve and the tensioner is in use.

5. The tensioner according to claim 4, wherein the elastic return force is provided by a spring surrounding the hollow rod.

6. The tensioner according to claim 3, further comprising:

a duct configured and arranged to guide the end of the safety line cable between an output of the hollow rod and the opening.

7. The tensioner according to claim 1, further comprising:

a flap configured and arranged to selectively seal the opening after an end of the safety line cable is cut.

8. A tensioner for a safety line cable comprising:

a fixing element coupled to a first end of the tensioner for fixing the tensioner to an external element;

a sleeve coupled proximate a second end of the tensioner for crimping a section of the safety line cable proximate the second end of the tensioner, the sleeve having a hole for passing the safety line cable through the sleeve;

a case having an opening, the opening in the case configured and arranged to allow an end of the safety line cable to pass through the sleeve and out of the opening of the case to allow access to the end of the safety line cable so a tension can be applied to the end of the safety line cable when the safety line cable is crimped in the sleeve; and a first section, the sleeve directly coupled to the first section;

a second section, the fixing element directly coupled to the second section; and a fastener configured and arranged to selectively release the first section from the second section as a direct result of a predetermined pulling apart force threshold encountered between the first section and the second section; and a stay assembly coupled to the second section; and an energy absorption member engaged with the first section and the stay assembly, the energy absorption member configured and arranged to absorb energy once the fastener releases the first section from the second section and maintain a coupling between the first section and the second section; and the energy absorption member including an absorption cable having a first absorption cable portion, a second absorption cable portion and a center absorption cable portion between the first absorption cable portion and the second absorption cable portion, the center absorption cable portion engaged with the first section, the first absorption cable portion terminating in a first limit stop and the second absorption cable portion terminating in a second limit stop; and the stay assembly including an upper plate and a lower plate, the upper plate and lower plate forming a first passage and a second passage, the first absorption cable portion received in the first passage and the second absorption cable portion received in the second passage, the first limit stop of the first absorption cable portion being larger than the first passage of the stay and the second limit stop of the second cable portion being larger than the second passage of the stay.

9. The tensioner according to claim 8, further comprising:

a flap configured and arranged to selectively seal the opening after an end of the safety line cable is cut.

10. The tensioner according to claim 8, further comprising:

a tightening screw configured and arranged to adjust a distance between the upper plate and the lower plate of the stay assembly to adjust a size of the first and second passages such that a friction force between the absorption cable and the stay assembly can be adjusted.

11. A tensioner comprising:

a sleeve configured and arranged to receive a safety line, the sleeve further configured to be crimped on the safety line to couple the sleeve to the safety line;

a first section, the sleeve directly coupled to the first section;

a fixing element configured and arranged to couple the tensioner to an external element;

a second section coupled to the first section, the fixing element being directly coupled to the second section;

a fastener configured and arranged to selectively release the first section from the second section as a direct result of a predetermined pulling apart force threshold encountered between the first section and the second section; and an energy absorption member engaged with the first section and the second section, the energy absorption member configured and arranged to absorb energy once the fastener releases the first section from the second section and the energy absorption member is configured and arranged to maintain a coupling between the first section and the second section once the fastener releases the first section from the second section.

12. The tensioner according to claim 11, wherein the fastener further comprises:

a threaded rod coupled to the first section; and a fuse nut threadably engaging the threaded rod, the fuse nut formed of material that is less hard than a material of the threaded rod.

13. The tensioner according to claim 11, wherein the energy absorption member further comprises;

a stay assembly coupled to the second section, the stay assembly including an upper plate and a lower plate, the upper plate and lower plate forming a first passage and a second passage; and an absorption cable having a first absorption cable portion, a second absorption cable portion and a center absorption cable portion between the first absorption cable portion and the second absorption cable portion, the center absorption cable portion engaged with the first section, the first absorption cable portion terminating in a first limit stop and the second absorption cable portion terminating in a second limit stop, the first absorption cable portion received in the first passage and the second absorption cable portion received in the second passage, the first limit stop of the first absorption cable portion being larger than the first passage of the stay and the second limit stop of the second cable portion being larger than the second passage of the stay.

14. The tensioner according to claim 11, further comprising:

a case encasing the first and second sections, the case having an opening configured and arranged to allow an end of the safety line to pass through the sleeve and out of the opening of the case to allow access to the end of the safety line so a tension can be applied to the end of the safety line when the safety line is crimped in the sleeve.

15. A method for fitting a safety line cable on the tensioner of claim 11, the method comprising a first step of crimping a section of the safety line cable in the sleeve of the tensioner.

16. The method according to claim 15, further comprising; after the first step of crimping, a second step of cutting an end of the cable projecting from the sleeve.

* * * * *